US006237157B1

(12) United States Patent
Lobbins

(10) Patent No.: US 6,237,157 B1
(45) Date of Patent: May 29, 2001

(54) EAR PROTECTION CAP

(75) Inventor: Claudette Yvonne Lobbins, San Diego, CA (US)

(73) Assignee: Claudette Y. Lobbins, San Diego, CA (US)

( * ) Notice: Subject to any disclaimer, the term of this patent is extended or adjusted under 35 U.S.C. 154(b) by 0 days.

(21) Appl. No.: 09/654,072

(22) Filed: Sep. 1, 2000

Related U.S. Application Data

(60) Provisional application No. 60/153,049, filed on Sep. 10, 1999.

(51) Int. Cl.[7] ..... A42B 1/06
(52) U.S. Cl. ..... 2/209; 2/174
(58) Field of Search ..... 2/209, 904, 423, 2/455, 174; 128/866; 1/864

(56) References Cited

U.S. PATENT DOCUMENTS

| | | | | |
|---|---|---|---|---|
| 190,720 | * | 5/1877 | Kleinert | 2/209 |
| 758,680 | * | 5/1904 | Otte | 2/209 |
| 1,772,223 | * | 8/1930 | Pence | 2/174 |
| 1,845,689 | * | 2/1932 | Turrell et al. | 2/174 |
| 2,325,150 | * | 7/1943 | Sahlmann | 2/209 |
| 2,396,113 | * | 3/1946 | Motley | 2/174 |
| 2,700,162 | * | 1/1955 | Fuller | 2/209 |
| 4,791,684 | * | 12/1988 | Schwartz | 2/209 |
| 5,628,070 | * | 5/1997 | Kefelian | 2/174 |
| 5,689,831 | * | 11/1997 | Harris | 2/209 |
| 5,718,001 | * | 2/1998 | Wright | 2/209 |
| 5,778,455 | * | 7/1998 | Joseph | 2/209 |
| 5,920,912 | * | 7/1999 | Patchett | 2/209 |
| 6,131,204 | * | 10/2000 | Otey | 2/209 |

* cited by examiner

*Primary Examiner*—Rodney Lindsey

(57) ABSTRACT

The present invention involves two heat resistant ear caps attached to a continuous flat woven cord. The caps are designed to protect the ears from burns during the treatment of hair with heated cosmetology curling irons, hot rollers, and dryers. The heat resistant ear caps are uniquely constructed to hook over the auricle (top) of the ears into a defined depth of the caps. The caps comprise an outer heat resistant fabric, an inner webbing and cotton denim fabric fused together. The unique construction is created by simultaneously stretching and sewing elastic between two defined points located on the fused fabrics thus creating a semi-circle opening with a defined depth which hooks over the ears. The outer edges of the semi-circle opening with a defined depth are covered and enclosed by a cotton lycra strip. The two caps are attached to a flat woven cord which adjusts underneath the chin by use of a manufactured cord lock. Further, this construction of pliable heat resistant fabrics allows the ear caps to be shaped around the ear area by human hands.

2 Claims, 1 Drawing Sheet

EAR PROTECTION CAP

This application claim benefit to provisional application Ser. No. 60/153,049 filed Sep. 10, 1999.

BACKGROUND OF THE INVENTION

1. Field of the Invention

The present invention relates to an ear protective covering device which protects the human ears from burns by heated cosmetology instruments during the treatment of hair.

2. Description of the Prior Art

U.S. Pat. No. 5,718,001 issued to Wright shows a device with mutually opposed ear coverings having a drawstring threaded through a central strap for adjusting the ear coverings securely about the ear. Additionally, the ear is totally enclosed inside each protective cap. By contrast the present invention contemplates a protective ear covering device which is designed to fit over the auricle (top) of the human ear and does not enclose the total ear in a bag-like bubble. The present invention does not use drawstrings. The protective cap is formed by simultaneously sewing and stretching elastic between two defined points near the top portion of the fabric. This unique construction forms a semi-circle pocket with a definite depth that fits over the auricle of the ear (top). A continuous cord is attached to the bottom middle of each protective device. The flat woven cord has a cord locking device that allows the protective caps to be adjusted underneath the neck. When the cord is adjusted underneath the neck, the degree of tightness desired by the user causes the protective ear devices to lay flat against the face and to fit the ears as snug or as loose as desired. The present design of protective ear caps allows the device to be adjusted by human hands around the area of ear. The present design of the ear protective device does not create a cavity to receive the ear. The semi-circle pocket with a definite depth created by the design is wide enough to cover the human ear and deep enough to hook and hold onto the auricle (top) of the ear. One size fits most.

U.S. Pat. No. 5,920,912, issued to Patchett shows a protective device for the human ear, a left and right member, connected by regular string or elastic to prevent the members from being lost and/or separated from each other. The design is such that the ears are totally enclosed inside the device, and elastic sewn around the perimeter of the device creates the cavity for the ear. There is no design for the user to adjust the ear devices if needed. By contrast, the present invention is designed to fit over the auricle of the human ear and does not enclose the total ear inside a bubble. The protective cap for the present invention is formed by using elastic, stretched and sewn from designated points on the fabric, which forms a semi-circle pocket with a definite depth that fits over the auricle of the ear. The ear devices do not form a cavity to receive the ear. When the caps are situated securely over the auricle (top) of the ear, they are wide enough to cover the entire ear and lay flat against the face. The present invention also has a continuous cord attached to the bottom middle of each protective cap which connects the two caps as one. The cord is secured underneath the neck with a cord locking device.

U.S. Pat. No. 4,223,407 issued to Zappala shows a protective hairdressing visor which can be used to protect the forehead and the ears from hairdressing preparations. The device is constructed with an all-in-one visor and fluid tight ear coverings. This device does not allow fill access to the hair during preparation. By contrast, the present invention has been designed to protect the ears and allows complete access to the hair. The present invention has been designed to also allow the two ear protective devices to slip easily over the auricle of the ear (top) into a semi-circle pocket with a defined depth and the ear devices are secured onto the ears by a soft woven cord attached to the bottom middle of each ear device. The cord is secured with a locking device attached to the cord which allows the devices to be adjusted as needed.

U.S. Pat. No. 4,616,643 issued to Jung discloses a protective ear covering designed to keep water out of the ears. The covering is attached to the user by an adhesive. By contrast, the present invention is designed to protect the ears from burns when heated cosmetology instruments are used during the treatment of hair. The protective devices are designed to slip easily over the auricle of the ear (top) into a semi-circle pocket with a defined depth and the ear devices are secured onto the ears by use of a flat woven cord which locks underneath the chin.

SUMMARY OF THE INVENTION

The present invention comprises a protective device which protects the human ears from burns during the application of heat to human hair. The device has a pair of protective caps designed to slip easily over the auricle (top) of the ears where the ears fit into a semi-circle pocket with a defined depth. The two ear devices are secured onto the ears by tightening a flat woven cord attached to the bottom middle of each protective device. The cord is adjustable underneath the chin by use of a cord lock.

It is the object of this invention to provide a simple and easy method to protect the ears from burns without complicated processes of drawstrings and insertion of the ear into a bag-like bubble. This invention overcomes the disadvantages of the previous art in that it is simple to use while it still protects the ears. The invention does not involve drawstrings usage nor does it require the ears to be totally enclosed in a bubble pouch. Another major feature of this improved ear protective device is its stylish design, ease of use, (slips easily over top of ears (auricle) and can be shaped to fit the ears with the human hand, and comfort provided the user.

Each protective device is developed by sealing together pliable TEFLON coated heat resistant fabric to medium weight cotton denim fabric. The two fabrics are sealed with a fusible webbing which provides body and tightness to each individual unit. The semi-circle pocket with a defined depth which hooks over the auricle (top) of the ear is formed by simultaneously sewing and stretching elastic between two defined points on the fabric. The inside facing of each unit consisting of TEFLON fabric is secured by sewing, gluing or any other means used to secure fabric in a stationary flat position. The outer perimeter of each device is covered with soft cotton-lycra fabric, bias strip. Attachment of the bias strip starts at one end (bottom) of each device and continues around the perimeter to the opposite end. This construction overlooks the outer edges of each device and provides softness and comfort to the user's ear and face area when the protective device is slipped over the ear. The construction continues with the bias strip, cotton-lycra, being attached horizontally to the bottom of each device wherein the flat woven cotton cord used to secure the devices onto the ears is also attached. Attachment of the cord to each device makes it one continuous unit. The cord attached to the ear caps is adjustable by a manufactured cord-lock device. A hand-tied or machine-made knot is placed at the bottom of the cord to secure the cord-lock.

Finally, it is the general idea of the invention to provide ease of use by constructing the caps with a defined depth to slip easily over top of the ears (auricle) and secures easily underneath the neck by a flat woven cord which contains a cord lock. It is also the general idea to provide comfort and effectiveness for its intended use (protection of the ears from burns).

DETAILED DESCRIPTION OF THE PREFERRED EMBODIMENTS

Figure 1:
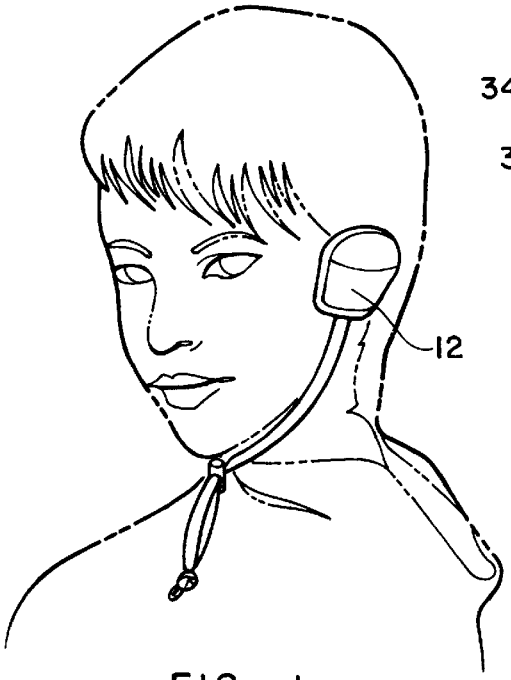
FIG. 1 is a view of one side of the protective ear devices worn by a user.

Referring to the drawings, FIG. 1 shows a view of one side of the protective earcap device of the present invention designated by number 12 shown in place on a user.

Figure 2:
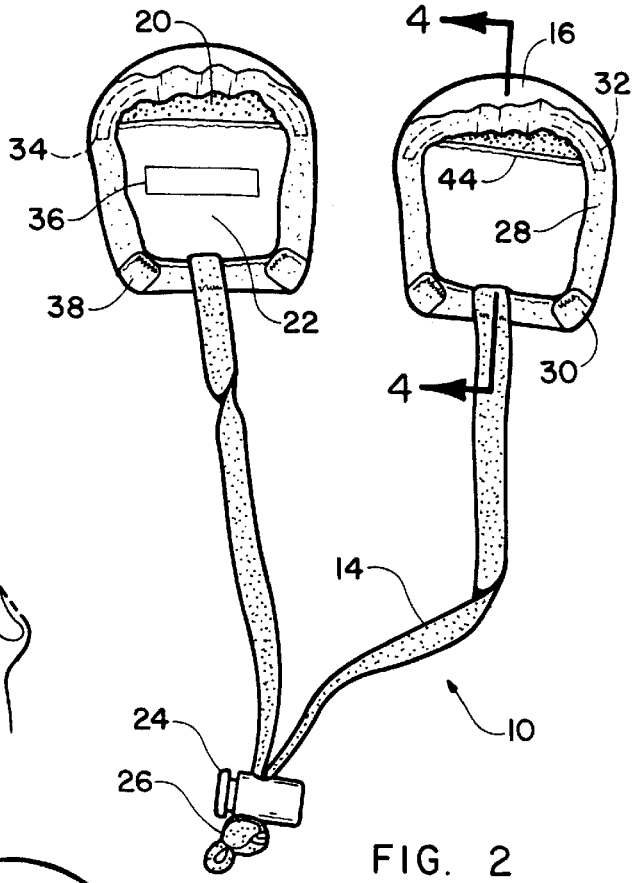
FIG. 2 is the inside view of the ear protective caps showing both caps joined by a flat woven cord with cord-lock secured by a knot (hand tied or machine-made).

The inside view of FIG. 2 shows the unique cons on of the invention. The outside fabric 16 is a heat resistant pliable fabric of TEFLON or polyetrafluoroethylene. The TEFLON fabric 16 is sealed to a cotton denim fabric 20 by fusing with heat a webb fabric 18 shown in FIG. 4. This fusion of fabrics, after total construction, provides the complete layers of thickness needed to protect the ears from heat of curlng irons, hair dryers and hot combs during preparation of hair. The unique construction of this invention will also be referenced in FIG. 3 and FIG. 4. However, all references will be FIG. 2 unless otherwise indicated.

Figure 4:
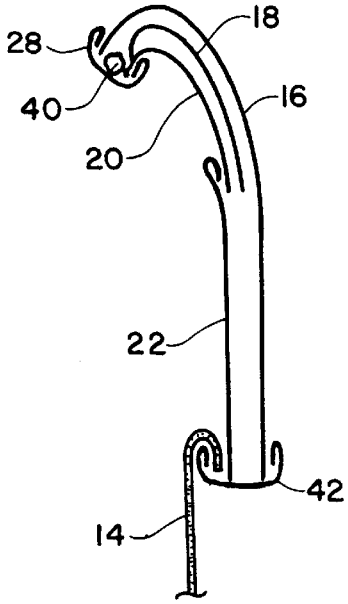
FIG. 4 is a blow-up 4 of the layout of the three types of fabrics, a view of the cotton bias strip, the inside facing, the elastic and the flat cording.

After fusion of fabrics 16, 18, & 20, FIG. 4, the cap portion 32 and 34 of the invention is created by simultaneously stretching and sewing elastic beginning at position 32 and ending at position 34 for each ear cap. This construction creates the depth of the fold which hooks over the pinnacle (top) of the ears 12 shown in FIG. 1. The facing 22 TEFLON fabric is attached to the inside of the fused fabrics 20, 16 and 18, FIG. 4 by stitching or other bonding means across the top edge at 44. This TEFLON facing 22 provides additional stability for the ear caps 10 on the inside and further shields and protects ears from hot air dispensed by hair dryers.

Elastic pieces 32 and 34, and the outside edges of facing 44 are banded by a cotton lycra bias strip 28 which is comfortable, smooth, cool and soft on the skin. The cotton lycra bias strip 28 is sewn starting at the bottom end of the right side tuck 30 and continuing around the invention to the opposite end on the left side tuck 38. This construction totally encloses all raw edges in the area 30 and 38 of the invention. The cotton lycra bias strip 42 FIG. 3 and FIG. 4 sewn across the bottom, horizontally, of each ear cap is tacked into the invention at corner tucks 30 and 38.

Figure 3:
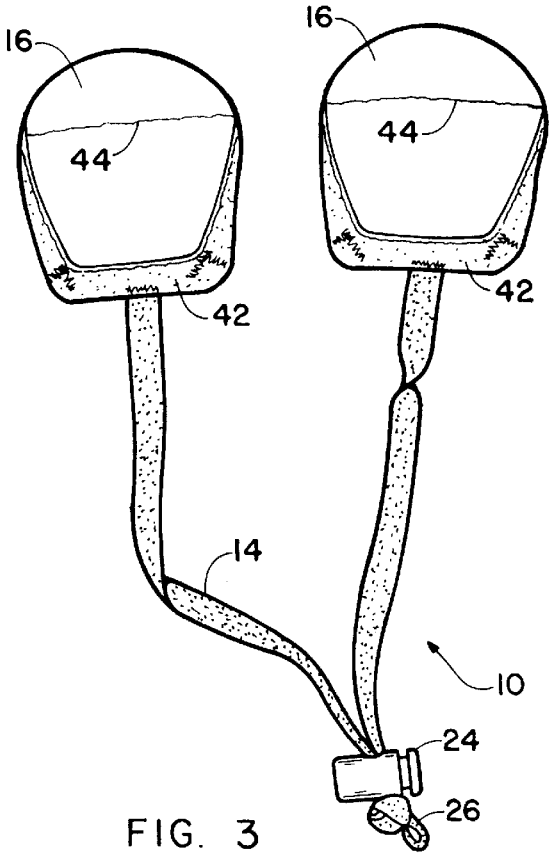
FIG. 3 is the outside view of the ear protective caps showing the stitching line where the inside facing is attached to each device and both caps are jointed by a flat woven cord with a cord-lock secured by a knot (hand tied or machine-made).

The flat woven cord 14, which connects the two caps together, device 10, is enclosed within the cotton bias strip 42, FIG. 3 and FIG. 4 at the bottom middle of each ear cap. The cord lock 24 is secured onto the fat woven cord by a hand tied or machine-made knot 26. The flat woven cord 14 allows the ear devices to be secured onto the ears by locking the flat woven cord underneath the neck using the cord-lock 24.

In operation, the device 10, two mutually opposed ear caps, are placed upright on top (auricle) of the user's ears where each ear fits into a semi circle opening with a defined dept. One size fits most, The use of soft cotton denim 20, fusible webbing 18 FIG. 4, and pliable Teflon fabric 16 with the cotton lycra bias strip 28 allows the caps to be shaped by human hands around the area of the ear. The flat woven cord 14 can be adjusted underneath the neck to secure the devices 10 comfortably onto the ears with a cord lock 24. The cord lock 24 is secured onto the flat woven cord 14 with a knot 26, hand-tied or machine-made. Once the devices 10 are secured over the ears and shaped by human hands to fit around the area of the ear, the user's hair can be styled as preferred.

FIG. 3. shows the invention with both ear devices 10 with a full outside view. FIG. 3 also shows full view of TEFLON fabric 16 with outside stitching line of facing 44, cotton lycra bias strip 42, flat woven cord at 14, cord-lock 24 and hand tied or machine-made knot 26.

FIG. 4. Shows a blow-up of FIG. 2 at Arrow 4 with a cross-view of layers of fabrics 16, 18, and 20; inside facing 22; cord 14; cotton bias strips 28 and 42, and the elastic 40.

It should be apparent from the foregoing description, that modifications and changes to the above described ear caps may be made without departing from the inventive scope thereof It is to be understood that the present invention is not limited to the sole embodiment described above, but encompasses all limitations applied thereto as described in the claim language herein.

I claim:

1. A device, which protects the human ears from burns during a hair styling process, comprising:

a pair of protective heat resistant caps designed to slip over the ears, and a cord and cord lock for connecting the caps, each cap comprising, an upper end for engagement with and slipping over the top of an ear, a lower end for extending from the upper end to below the ear, an outer layer of heat resistant TEFLON fabric extending from the upper end to the lower end and having an upper area at the upper end and a lower area at the lower end, an inner layer of cotton denim fabric defining an upper end and a lower end and fused by a web fabric to the upper area of the outer layer, an inner layer of heat resistant TEFLON fabric having an upper end and a lower end and attached to the lower area of the outer layer and extending from the lower end of the cotton denim fabric at its upper end to the lower end of the outer layer at its lower end, an elastic member sewn at the upper end of the cap from a first point to a second point on the upper end of the cap while simultaneously stretching the upper end of the cap for creating a depth for hooking over the top of the ear, and edges of the layers banded by a cotton lycra bias strip for being comfortable, smooth and soft on the skin.

2. The device of claim 1 wherein the cord includes a knot for blocking disengagement of the cord lock.

* * * * *